US006851557B1

(12) United States Patent
Svoboda

(10) Patent No.: US 6,851,557 B1
(45) Date of Patent: Feb. 8, 2005

(54) FERROHYDROSTATIC SEPARATION METHOD AND APPARATUS

(76) Inventor: Jan Svoboda, 158 Cornelis Street, Fairland (ZA), 2195

( * ) Notice: Subject to any disclaimer, the term of this patent is extended or adjusted under 35 U.S.C. 154(b) by 0 days.

(21) Appl. No.: 09/913,887

(22) PCT Filed: Feb. 15, 2000

(86) PCT No.: PCT/IB00/00156

§ 371 (c)(1),
(2), (4) Date: Dec. 14, 2001

(87) PCT Pub. No.: WO00/48740

PCT Pub. Date: Aug. 24, 2000

(30) Foreign Application Priority Data

Feb. 17, 1999 (ZA) ..... 99/1255

(51) Int. Cl.[7] ..... B03C 1/30
(52) U.S. Cl. ..... 209/39; 209/232
(58) Field of Search ..... 209/1, 39, 231, 209/232, 214, 213, 223.1, 172, 172.5, 173; 210/222, 223

(56) References Cited

U.S. PATENT DOCUMENTS 3,483,968 A 12/1969 Kaiser
3,788,465 A 1/1974 Reimers
3,898,156 A * 8/1975 Kaiser et al. ..... 209/1
4,052,297 A * 10/1977 Mir ..... 209/1
4,062,765 A 12/1977 Fray et al.
4,085,037 A * 4/1978 Quets et al. ..... 209/1
4,961,841 A * 10/1990 Andres et al. ..... 209/1
5,053,344 A * 10/1991 Zborowski et al. ..... 436/177
5,541,072 A * 7/1996 Wang et al. ..... 435/7.21
5,762,204 A * 6/1998 Yang et al. ..... 209/172.5
5,993,665 A * 11/1999 Terstappen et al. ..... 210/695

FOREIGN PATENT DOCUMENTS

FR 2 336 980 7/1977

* cited by examiner

*Primary Examiner*—Donald P Walsh
*Assistant Examiner*—Joseph Rodriguez
(74) *Attorney, Agent, or Firm*—Jones Day

(57) ABSTRACT

The invention concerns in one aspect, a ferrohydrostatic separation method in which a ferrofluid is used to separate materials of different density. In the method, the apparent density of the ferrofluid is controlled by means of a vertically orientated magnetic field generated by a C-dipole, open dipole (O-dipole) or split pair electromagnet or permanent magnet. Other aspects of the invention include an apparatus for use in this method and a process for separating materials of different density using the method.

10 Claims, 6 Drawing Sheets

FERROHYDROSTATIC SEPARATION METHOD AND APPARATUS

BACKGROUND TO THE INVENTION

THIS invention relates to a ferrohydrostatic separation (FHS) method and apparatus.

As defined in the specification of U.S. Pat. No. 3,483,969, a ferrofluid is a material comprising a permanent, stable suspension of ferromagnetic material in a suitable liquid carrier. A common ferrofluid comprises fine particles typically 10–8M or less in size) of magnetite in a liquid. In this case, the extremely fine nature of the particles maintains them indefinitely in suspension without sinking or agglomerating.

The use of a ferrofluid to separate materials of different densities, referred to in the art as ferrohydrostatic separation (FHS), is also known and is, for instance, described in the specification of U.S. Pat. No. 3,483,969. The materials which are to be separated can be solid particulate materials or liquids which are immiscible with the carrier liquid of the ferrofluid. In essence, the separation process involves applying a magnetic field of a specific pattern to the ferrofluid with a view to controlling the apparent density of the ferrofluid within close limits. The materials which are to be separated are then deposited in the ferrofluid with the result that those materials which have a density exceeding the controlled apparent density of the ferrofluid will sink in the ferrofluid while those which have a density less than that of the ferrofluid will float in the ferrofluid. The sink and float fractions can then be recovered separately.

In all known prior art FHS separators using ferrofluids and employing electromagnets or permanent magnets with an iron yoke, the magnetic field of a specific pattern is generated in a horizontal direction with the ferrofluid situated between the pole tips of the magnet. This arrangement has the significant disadvantage that in order to achieve a magnetic field across a suitably large volume to enable the FHS technique to be used for large material throughputs, it is necessary to increase the gap between the pole tips of the magnet. This in turn results in a large and uneconomical increase in the volumes of copper and iron required to construct the magnet and, in general, in the overall size and mass of the separation apparatus. In addition, the arrangement does not lend itself to large scale-up to treat large tonnages of material.

To overcome these limitations of the conventional iron yoke-based design with a horizontally orientated magnetic field, the specification of South African patent ZA 97/9598 proposes an arrangement in which a magnetic field with specific pattern is generated in a vertical direction by means of a solenoid, typically with a ncn~uniform winding. The use of a solenoid has numerous advantages compared to the use of an iron yoke electromagnet or permanent magnet, these being set out in the aforementioned patent specification. For instance, with a solenoid it is possible to increase the throughput merely by increasing the relevant transverse dimension of the solenoid, the axial length of the air gap remaining constant.

Although the solenoid-based proposal described in the aforementioned patent specification provides the ability to scale up the FHS technique to treat large volumes of material, the relative complexity of the winding design and of the steel cladding, together with the necessity to generate a rather high magnetic field in order to achieve the desired field pattern, are inherent disadvantages. Since a modest magnetic field strength is generally required in the FHS technique these drawbacks can, however be countered by taking advantage of the high saturation magnetisation of steel.

Another disadvantage of the conventional iron yoke FHS systems is the fact that the gradient of the magnetic field is proportional to the magnetic field strength. In order to achieve a low apparent density of the ferrofluid, for example to separate low-density materials such as coal, low magnetic field gradient and field strength are required. However the field may then be unable to retain the ferrofluid in the separation gap, necessitating complicated mechanical means to prevent the ferrofluid from running cut of the gap.

SUMMARY OF THE INVENTION

According to the present invention the apparent density of a ferrofluid used in an FHS technique is controlled by a vertically orientated magnetic field generated by a C-dipole, open dipole (O-dipole) or split pair electromagnet or permanent magnet.

The required magnetic field pattern in the vertical direction, for example including constant magnetic field gradient, can be achieved in the case of a C-dipole electromagnet by appropriate design of the magnetising coils on upper and lower legs of the C-dipole and/or by controlling the relative polarity of electrical current flowing through these coils and/or by appropriate shaping of the C-dipole tips.

In the case of a split pair electromagnet, the required magnetic field pattern in the vertical direction, for example including a constant magnetic field gradient, can be achieved by appropriate design of the magnetising coils on upper and lower members of the split pair and/or by controlling the relative polarity of electrical current flowing through these coils and/or by appropriate shaping of the tips of the upper and lower members.

The required magnetic field pattern in the vertical direction, for example a constant magnetic field gradient, can be achieved in the case of an O-dipole electromagnet by appropriate shaping of the steel core of the magnet and/or by appropriate design of the magnetising coil.

Another aspect of the invention provides a method of separating materials of different density comprising introducing the materials into a ferrofluid, using a C-dipole, O-dipole or split pair magnet to generate a magnetic field to control the apparent density of the ferrofluid to a value between the densities of the materials, and separately recovering materials which sink and float therein.

Still further according to the invention there is provided a ferrohydrostatic separation apparatus for separating materials having different densities, the apparatus including a separation chamber for accommodating a ferrofluid into which the materials can be introduced, and a C-dipole, O-dipole or split pair magnet adjacent the chamber for generating a magnetic field to control the apparent density of the ferrofluid.

The use of a C-dipole, O-dipole or split pair magnet has several advantages when compared to the use of a conventional iron yoke electromagnet or permanent magnet, as follows:

1. As explained above, the throughput in the conventional system requires the gap between the pole tips to be increased. However with a C-dipole, O-dipole or split pair magnet system as proposed by this invention, throughput can be increased merely by increasing the length of the magnet, leaving the air gap between the pole tips constant. Because the number of ampere-turns rewired to generate a given magnetic field is dependent on the air gap, which remains constant in C-dipole, O-dipole and split pair configurations, it is possible to scale up a C-dipole, O-dipole or split pair magnet to any practical size while keeping the number of ampere-turns constant.

2. The magnetic field along the length of a C-dipole, O-dipole or split pair magnet is homogeneous. Thus the same magnetic field pattern and apparent ferrofluid density can be maintained along the full length of the magnet and that full length can be used for separation purposes, resulting overall in a more compact separator.
3. Because a rather low magnetomotive force is required to magnetically saturate mild steel and the saturation magnetisation of mild steel is high, the magnetic field strength at the pole tips of a C-dipole, O-dipole or split pair magnet can be considerably greater than in the working gap of the iron yoke magnet used in conventional FHS systems. It is accordingly possible to use a more diluted ferrofluid having a lower density and magnetisation. This can lead to a reduction in ferrofluid costs, and it is envisaged that the efficiency of the separation process can improve as a result of the reduced viscosity of the more dilute ferrofluid.

DESCRIPTION OF EMBODIMENTS OF THE INVENTION

Figure 1:
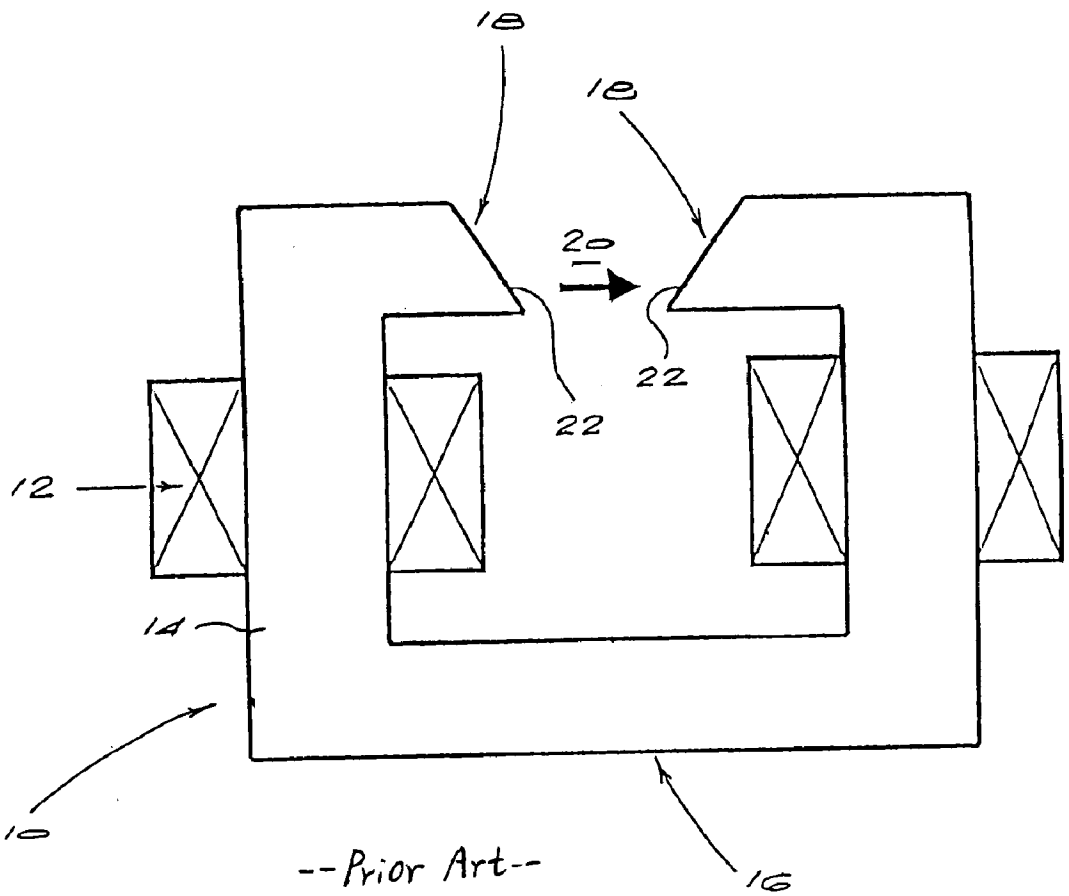
FIG. 1 shows a prior art electromagnet using windings arranged about the limbs of an iron yoke.

FIG. 1 shows an electromagnet 10 which includes windings 12 arranged about the limbs 14 of an iron yoke 16 having pole tips 18. A working space 20 is defined between the pole tips 18. As indicated by the arrow, a horizontally orientated magnetic field is generated between the pole tips 18 which, at the same time, generate a vertically orientated magnetic field gradient.

In a conventional FHS separation system employing a magnet 10 of this type, a ferrofluid, typically a suspension of fine magnetite particles in stable suspension in a suitable liquid, is located in the working space 20 between the pole tips. The apparent density of the ferrofluid is controlled to a desired value by ensuring that the magnetic field gradient is kept at least approximately constant. The surfaces 22 of the pole tips must be carefully designed to ensure that the magnetic field gradient is as constant as possible.

Materials which are to be separated into fractions of different density respectively greater and less than the controlled apparent density of the ferrofluid are introduced into the ferrofluid, with the result that the denser particles sink while the less dense particles float.

As described above, in order to treat large throughputs of material, the gap between the pole tips must be increased, resulting in an increase in the volumes of iron and copper required to construct the magnet, in the energy required to generate the magnetic field and in the overall size and mass of the separator. These increases limit the practical scale-up of the separator so that only modest throughputs can be treated using separators based on this conventional magnet design.

Figure 2:
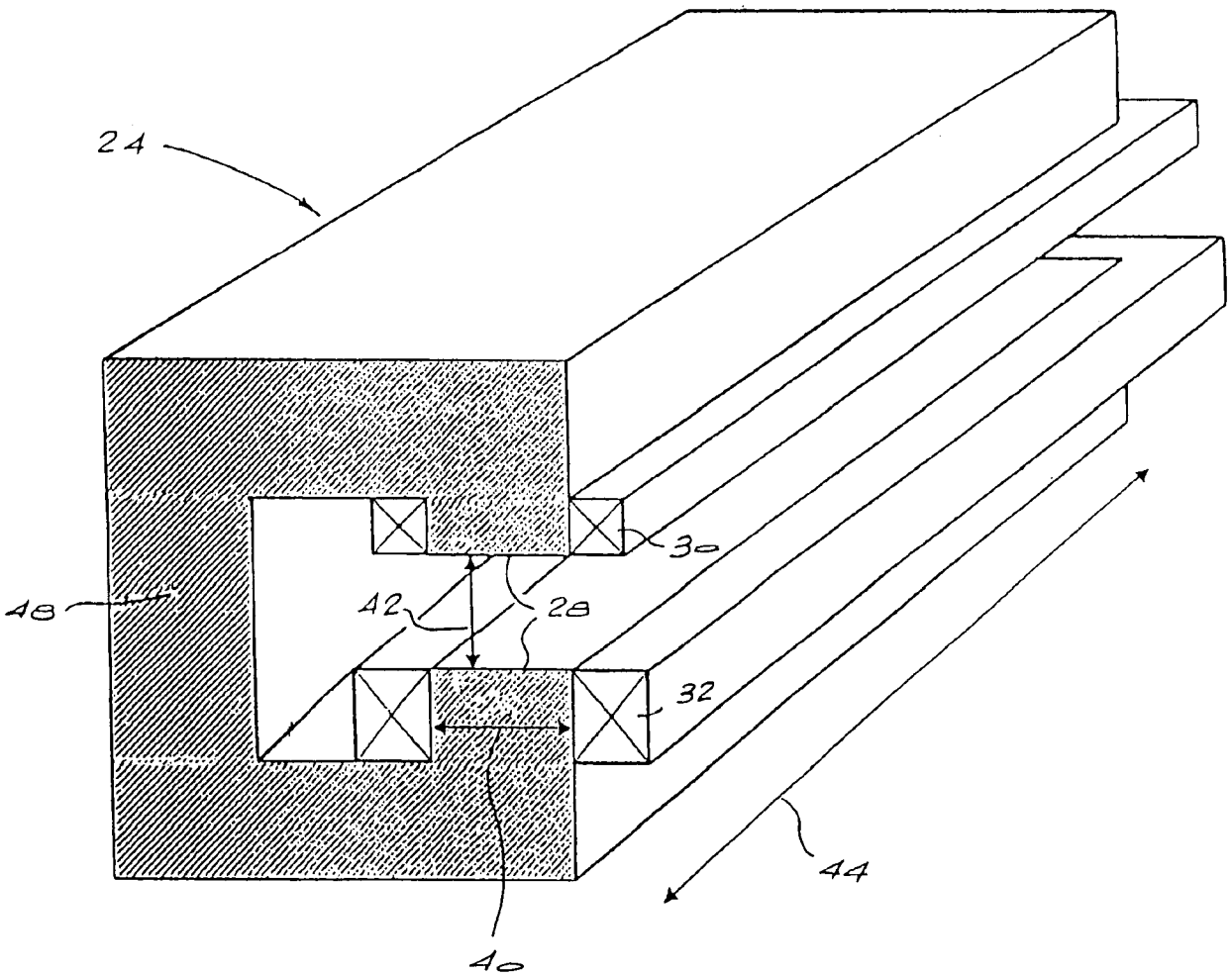
FIG. 2 shows one embodiment of the present invention using a C-dipole magnet.
Figure 3:
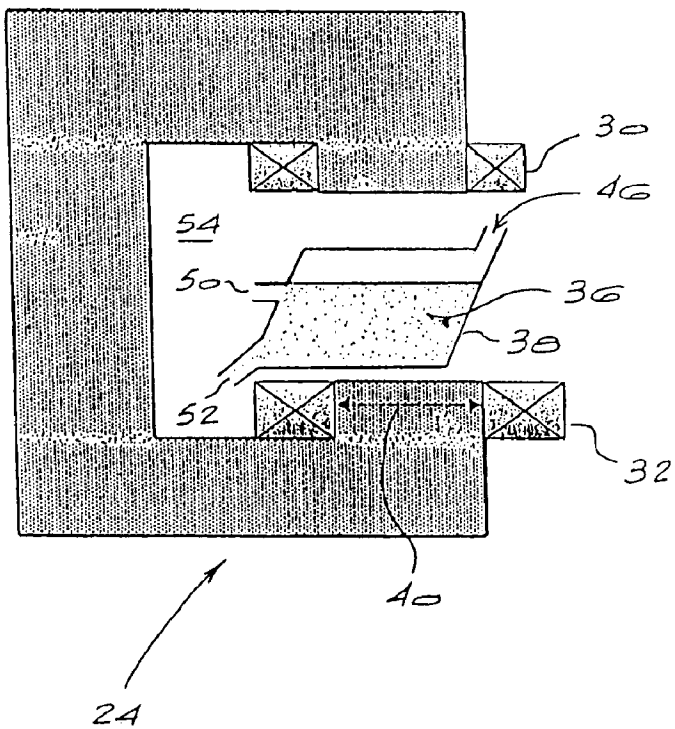
FIG. 3 shows the C-dipole magnet in FIG. 2 with a ferrofluid chamber inserted between the poles of the magnet.
Figure 4:
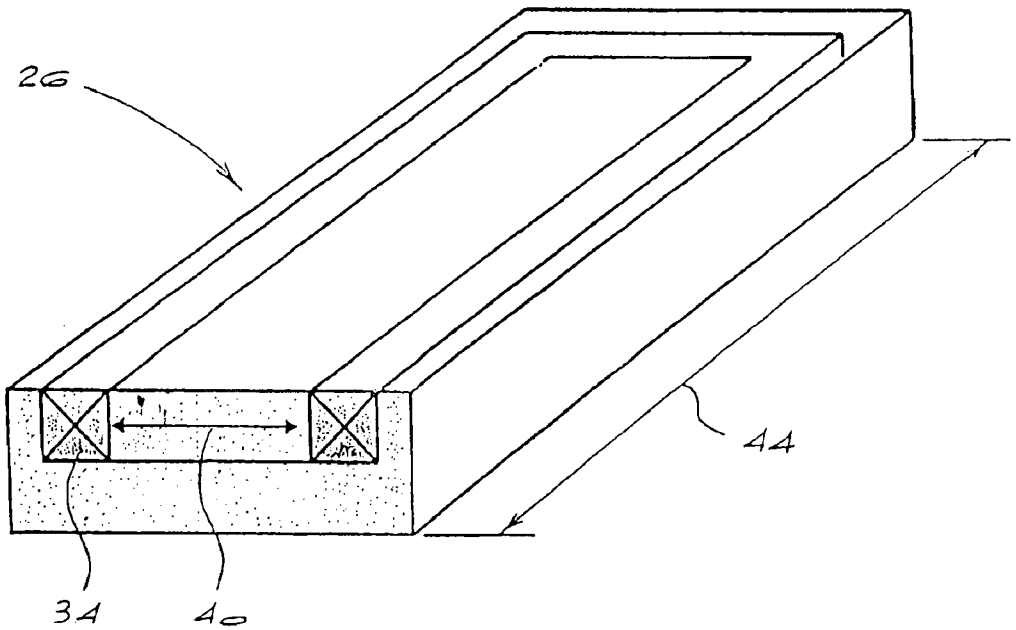
FIG. 4 shows another embodiment of the present invention using an O-dipole configuration.
Figure 5:
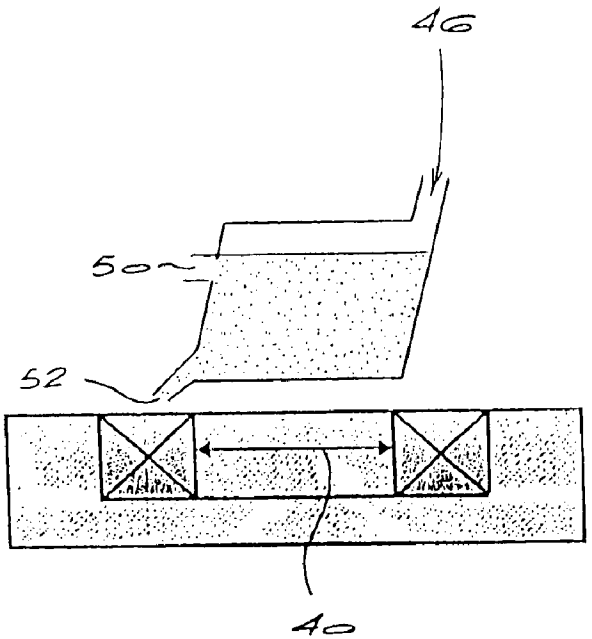
FIG. 5 shows an O-dipole magnet in FIG. 4 with a ferrofluid chamber.
Figure 6:
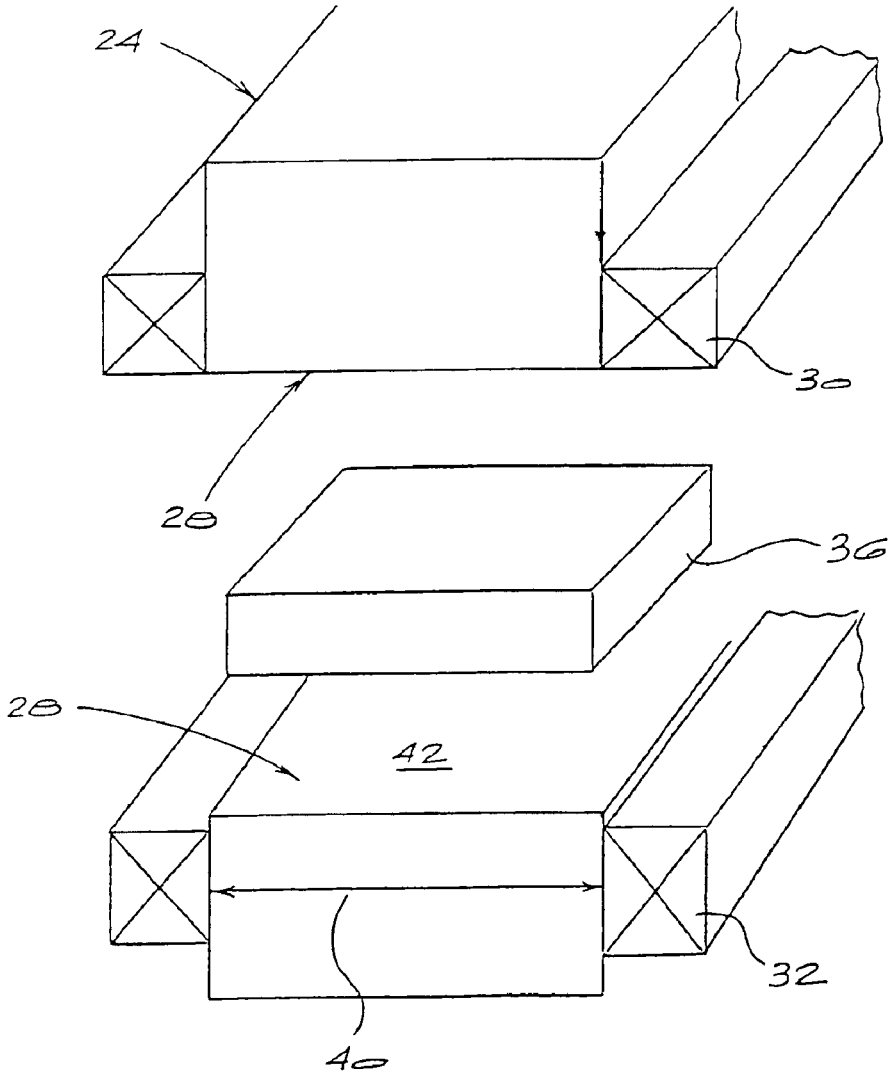
FIG. 6 shows another embodiment of the present invention using a split pair

Reference is now made to FIGS. 2 to 6, illustrating embodiments of the present invention in which the conventional iron yoke magnet is replaced by a C-dipole, O-dipole (open-dipole) or split pair magnet with a mild steel core, and which are capable of separating materials at high throughput rates. FIGS. 2 and 3 illustrate a C-dipole magnet 24, FIGS. 4 and 5 illustrate an O-dipole magnet 26 and FIG. 6 illustrates a split pair magnet according to the invention.

In each case, the magnet generates a vertically orientated magnetic field which has a natural gradient since the field strength is greatest on the surface of the pole tips 28. By judicious design of the windings 30 and 32 in FIGS. 2 and 3 and in FIG. 6, and 34 in FIGS. 4 and 5, and by appropriate adjustment of the relative polarities of the electric current flowing in the coils it is possible to adjust the vertically orientated magnetic field gradient so that it is constant in a volume 36 of ferrofluid accommodated in a separation chamber 38.

The width 40 of the pole tips in each case is determined by the width of the separation chamber 38 which is in turn determined by the required residence time in the ferrofluid of the material which is to be separated. In FIGS. 2 and 3 and in FIG. 6, the vertical distance 42 between the pole tips 28 is determined mainly by the vertical dimension of the chamber 38. In these embodiments, the overall length 44 of the magnet determines the throughput of the separator, and can be made as great as is practically feasible to give the required throughput. The dimensions 40 and 42, and hence the magnetomotive force required to generate the required magnetic field, are the same irrespective of the dimension 44 and accordingly of the throughput of the separator. In a typical example, the dimensions 40, 42 and 44 may be 400 mm, 300 mm and 1 meter (or more) respectively.

Feed material 46 is introduced into the chamber 38, typically by means of a vibratory feeder, along the entire length 44 of the magnet 24, 26. In the embodiment of FIGS. 2 and 3 the feed material can be introduced into the ferrofluid either from the outside, as indicated in FIG. 3, or through openings (not illustrated) in the wall 48 of the magnet structure. In FIG. 6 the chamber 38 is shown in particularly diagrammatic form but it will be understood that it could have a form similar to that shown in the other Figures.

As is conventional in the FHS technique, particles in the feed material which have a density less than the apparent density of the ferrofluid, as controlled by the magnetic field, will float in the ferrofluid and report to an elevated outlet 50.

Particles which have a density exceeding the apparent density of the ferrofluid sink through the ferrofluid and are withdrawn through a lower chute 52. Both float and sink fractions are withdrawn continuously.

In FIGS. 2 and 3 the fractions can, for example, be removed on respective conveyor belts or other transport systems moving in the space 54 defined between the arms of the C-dipole magnet 24. In situations where this would be impossible because the feed material is introduced through openings in the wall 48, suitable transport systems could operate on the opposite side of the separation chamber 38.

It will be understood that in the O-dipole configuration of FIGS. 4 and 5 and the split pair configuration of FIG. 6, the geometry of the magnet structure imposes less limitations on the positioning of the feed introduction and separated fraction withdrawal systems.

Mention was made above of the disadvantages faced by conventional iron yoke FHS systems when dealing with low density materials such as coal. However in the C-dipole, O-dipole and split pair arrangements proposed by the present invention, the magnetic field is able to hold magnetically diluted ferrofluid suitable for low density applications even at the low magnetic field gradients required to achieve separation.

It is also recognised that in conventional iron yoke FHS systems, the range of apparent densities which can be achieved with a given design of the magnetic circuit and pole tip profile is rather limited. In the C-dipole and split pair configurations proposed by the present invention, however, the magnetic field gradient and thus the apparent density of the ferrofluid can be varied widely by adjusting the electrical currents and the polarities thereof, flowing through the upper and lower windings 30 and 32. It is envisaged that apparent densities as a high as 25 $gcm^{-1}$ could be achieved using a single C-dipole or split pair separator.

Although specific reference has been made to the use of a C-dipole, O-dipole or split pair electromagnet, the use of a C-dipole, O-dipole or split pair permanent magnet is within the scope of the invention. In these cases, variation of the apparent density of the ferrofluid is achieved by appropriate design of the core of the magnet and/or the shape of the pole tips.

What is claimed is:

1. A ferrohydrostatic separation method comprising the steps of:

providing a ferrofluid;

controlling the density of the ferrofluid to a substantially constant value by means of a vertically orientated magnetic field generated by a C-dipole, an open dipole (O-dipole), or split pair electromagnet or permanent magnet;

introducing materials of different densities into the ferrofluid; and separately recovering materials which sink and float in the ferrofluid.

2. The method according to claim 1, wherein the vertically orientated magnetic field is generated by a C-dipole and a required vertically orientated magnetic field pattern is achieved by means of magnetizing coils on upper and lower legs of the C-dipole.

3. The method according to claim 1, wherein the vertically orientated magnetic field is generated by a C-dipole and a required vertically orientated magnetic field pattern is achieved by controlling the relative polarity of electrical current flowing through magnetizing coils on upper and lower legs of the C-dipole.

4. The method according to claim 1 wherein the vertically orientated magnetic field is generated by a C-dipole having tips which face one another, the tips being shaped to produce a required vertically orientated magnetic field pattern.

5. The method according to claim 1 wherein the vertically orientated magnetic field is generated by a split pair electromagnet and a required vertically orientated magnetic field pattern is achieved by means of magnetizing coils on upper and lower members of the split pair.

6. The method according to claim 1 wherein the vertically orientated magnetic field is generated by a split pair electromagnet and a required vertically orientated magnetic field pattern is achieved by controlling the relative polarity of electrical current flowing through magnetizing coils on upper and lower members of the split pair.

7. The method according to claim 1 wherein the vertically orientated magnetic field is generated by a split pair electromagnet having upper and lower members having tips facing one another, the tips being shaped to produce a required vertically oriented magnetic field pattern.

8. The method according to claim 1 wherein the vertically orientated magnetic field is generated by an O-dipole electromagnet having a steel core shaped to produce a required vertically orientated magnetic field pattern.

9. The method according to claim 1 wherein the vertically orientated magnetic field is generated by an O-dipole electromagnet and a required vertically orientated magnetic field pattern is achieved by means of a magnetizing coil of the electromagnet.

10. The method according to claim 1 wherein a required vertically orientated magnetic field pattern is achieved with the provision of a substantially constant magnetic field gradient.

* * * * *